US008256892B2

(12) United States Patent
Chen et al.

(10) Patent No.: US 8,256,892 B2
(45) Date of Patent: Sep. 4, 2012

(54) HIGH PERFORMANCE POROUS INK-JET MEDIA WITH SUPERIOR IMAGE QUALITY

(75) Inventors: Tienteh Chen, San Diego, CA (US); Vladimir Shuzky, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 195 days.

(21) Appl. No.: 12/812,893

(22) PCT Filed: Jan. 15, 2008

(86) PCT No.: PCT/US2008/000528

§ 371 (c)(1),
(2), (4) Date: Jul. 14, 2010

(87) PCT Pub. No.: WO2009/091361

PCT Pub. Date: Jul. 23, 2009

(65) Prior Publication Data

US 2011/0115868 A1 May 19, 2011

(51) Int. Cl.

| | |
|---|---|
| ***B41J 3/407*** | (2006.01) |
| ***B05D 1/36*** | (2006.01) |
| ***B41M 5/40*** | (2006.01) |
| ***B41M 5/00*** | (2006.01) |

(52) U.S. Cl. ..... 347/106; 427/407.1; 428/32.3; 428/195.1

(58) Field of Classification Search ..... None
See application file for complete search history.

(56) References Cited

U.S. PATENT DOCUMENTS

| | | | | |
|---|---|---|---|---|
| 5,418,078 | A * | 5/1995 | Desie et al. | 428/32.3 |
| 5,908,723 | A * | 6/1999 | Malhotra et al. | 430/31 |
| 6,472,053 | B1 | 10/2002 | Hoshino et al. | |
| 6,833,169 | B2 | 12/2004 | Kasperchik et al. | |
| 2003/0081093 | A1 * | 5/2003 | Iijima et al. | 347/100 |
| 2004/0066439 | A1 | 4/2004 | Kasperchik et al. | |
| 2004/0202832 | A1 * | 10/2004 | Nigam et al. | 428/195.1 |
| 2006/0083871 | A1 | 4/2006 | Chen | |

OTHER PUBLICATIONS

Search Report from International Searching Authority for PCT/US2008/000528 dated Sep. 29, 2008.

* cited by examiner

*Primary Examiner* — Stephen Meier
*Assistant Examiner* — Alexander C Witkowski

(57) ABSTRACT

A print medium for ink-jet printing can comprise a base substrate; an ink-receiving layer comprising metal oxide particulates or semi-metal oxide particulates and a binder; and a gloss layer comprising colloidal silica and greater than 5 wt % of a copolymer of vinylpyrrolidone. The ink-receiving layer can be positioned between the substrate and the gloss layer.

25 Claims, No Drawings

HIGH PERFORMANCE POROUS INK-JET MEDIA WITH SUPERIOR IMAGE QUALITY

BACKGROUND

There are several reasons that ink-jet printing has become a popular way of recording images on various media surfaces, particularly paper. Some of these reasons include low printer noise, capability of high-speed recording, and multi-color recording. Additionally, these advantages can be obtained at a relatively low price to consumers. Though there has been great improvement in ink-jet printing, accompanying this improvement are increased demands by consumers in this area, e.g., higher speeds, higher resolution, full color image formation, increased ink stability, etc.

There are a variety of known methods for fabricating an ink jet recording sheet, or print media having a glossy surface for photographic type printing. One example is directed to a single layer coated paper that uses alumina in the ink-receiving layer. The commercial paper coated with alumina can provide good gloss and absorbing capacity, but it has poor scratch resistance, poor air fading resistance, and can cockle when the paper is wetted. Alternatively, silica particulates have also been used to coat paper. Coatings based on silica pigment often have better porosity, are less hygroscopic, and can have better air and light fading resistance, but tend to have poor gloss and scratch resistance.

DETAILED DESCRIPTION

Before the present invention is disclosed and described, it is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

In describing and claiming the present invention, the following terminology will be used in accordance with the definitions set forth below.

It is noted that, as used in this specification and the appended claims, the singular forms "a," "an," and "the" include plural referents unless the context clearly dictates otherwise. Thus, for example, reference to "a copolymer" includes one or more of such copolymers, and reference to "the print medium" includes reference to one or more print mediums.

As used herein, the term "base substrate" or "substrate" includes any material that can be used in the ink-jet printing arts including raw base paper and other papers, coated papers, art papers (e.g. water color paper), plastic sheets such as transparencies, and the like. The base substrate does not include the multiple coatings as described herein that are applied to the substrate.

As used herein, the term "plurality" refers to more than one. For example, a plurality of polymers refers to at least two polymers.

As used herein, the term "copolymer" refers to a polymer having more than one polymerized monomer. As such, this term also includes a polymer having more than two monomers, e.g., terpolymers.

As used herein, the term "20° gloss" or "gloss" refers to the ability of a surface to reflect light into the specular direction as measured with an incident angle of 20°.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

It has been recognized that it would be advantageous to develop high performance media sheets with superior gloss. In contrast to traditional ink jetphotographic materials, the present disclosure provides ink-jet print media that provides high gloss through a gloss layer while maintaining waterfastness, humid fastness, and colorant affinity. This media is suitable for both dye- and pigment-based ink-jet printing applications.

More specifically, in accordance with this, the present disclosure is drawn to a print medium for ink jetprinting, comprising a base substrate; an ink-receiving layer applied directly to the base substrate that comprises metal oxide particulates or semi-metal oxide particulates and a binder; and a gloss layer applied directly to the ink-receiving layer that comprises colloidal silica and greater than 5 wt % of a copolymer of vinylpyrrolidone.

Additionally, a method of manufacturing a print medium can comprise steps of coating a base substrate with an ink-receiving layer, where the ink-receiving layer comprises metal oxide particulates or semi-metal oxide particulates and a binder; and coating the ink-receiving layer with a gloss layer, where the gloss layer comprises colloidal silica and greater than 5 wt % of a copolymer of vinylpyrrolidone.

It is noted that when discussing the print medium and the methods described herein, each of these specific discussions can be considered applicable to each of these embodiments, whether or not they are explicitly discussed in the context of that embodiment. Thus, for example, in discussing the gloss layer, the gloss layer discussion can be relevant to the print medium embodiments and/or the method embodiments.

Base Substrate

The ink-jet recording medium can be formed on a base substrate or support. The base substrate can be raw base paper and other paper, coated paper, fabric, art paper (e.g. water color paper), plastic sheets such as transparencies, or can comprise other materials commonly used to support ink-receiving layers; examples include polyethylene-extruded photobase, film base, and highly sized paper base. In one embodiment, P-E photobase can be employed as the substrate, due to its higher gloss, water resistance, and "feel" (like a photo). As such, the substrate can further include a moisture barrier layer extruded on one side of the raw base paper. Thus, though three layers are generally described herein, e.g., base substrate, ink-receiving layer, and gloss layer, it is noted that any of these layers can be multi-layered of themselves. In one embodiment, any number of traditionally used paper fiber substrates can be used to form the raw base paper of the base substrate. More specifically, according to one embodiment, any number of raw base paper supports can be employed in the practice of the present method. Examples include, but are not limited to, any un-extruded paper that includes fibers, fillers, additives, etc., used to form an image supporting medium. More specifically, the substrate in the form of a raw base paper core may be made of any number of fiber types including, but not limited to, virgin hardwood fibers, virgin softwood fibers, recycled wood fibers, or the like.

In addition to the above-mentioned fibers, the base substrate can include a number of filler and additive materials. In one embodiment, the filler materials include, but are not limited to, calcium carbonate ($CaCO_3$), clay, kaolin, gypsum (hydrated calcium sulfate), titanium oxide ($TiO_2$), talc, alumina trihydrate, magnesium oxide (MgO), minerals, and/or synthetic and natural fillers. In one embodiment, if raw base paper or other fibrous base substrate is used as the base substrate, up to 40% by dry weight of the raw base paper core substrate may be made up of fillers. Inclusion of the above-mentioned fillers can reduce the overall cost of the raw base paper core substrate or other base substrate in a number of ways. On the other hand, the inclusion of white filler such as calcium carbonate may enhance the brightness, whiteness, and the quality of the resulting image supporting medium.

Other additives that may be included are sizing agents such as metal salts of fatty acids and/or fatty acids, alkyl ketene dimer emulsification products and/or epoxidized higher fatty acid amides; alkenyl or alkylsuccinic acid anhydride emulsification products and rosin derivatives; dry strengthening agents such as anionic, cationic or amphoteric polyacrylamides, polyvinylalcohol, cationized starch and vegetable galactomannan; wet strengthening agents such as polyamine-polyamide epichlorohydrin resin; fixers such as water-soluble aluminum salts, aluminum chloride, and aluminum sulfate; pH adjustors such as sodium hydroxide, sodium carbonate and sulfuric acid; optical brightening agents; and coloring agents such as pigments, coloring dyes, and fluorescent brighteners. Additionally, the base substrate can include any number of retention aids, drainage aids, wet strength additives, de-foamers, biocides, dyes, and/or other wet-end additives.

In addition to the above-mentioned filler and additive materials, less than 20 wt % of the base substrate might be fine content, e.g., content having a particle size of 0.2-5 microns including chopped or fragmented small woody fiber pieces formed during the refining process of the pulp. In one embodiment, the fine content may range from about 4 wt % to 10 wt % (dry).

Also, it is noted that the base substrate may be coated paper, such as photobase or other known coated papers. Plastic sheets such as transparencies can also be used, It is noted that any of these configurations of base substrate material can be used, as long as the ink-receiving layer and the gloss layer are sequentially applied thereto.

Ink-Receiving Layer

In accordance with embodiments of the present disclosure, at least one side of the base substrate can be coated with an ink-receiving layer, or alternatively, the ink-receiving layer can comprise a plurality of similar layers, as is know in the art. The ink-receiving layer can include inorganic particulates. Additionally, the inorganic particulates can include metal oxides and/or semi-metal oxides. In one embodiment, the metal oxides and/or semi-metal oxides can be fumed silica.

Generally, the inorganic particulates can include any number of inorganic oxide groups including, but not limited to silica and/or alumina, including those treated with silane coupling agents containing functional groups or other agents such as aluminum chlorohydrate (ACH) and those having oxide/hydroxide. If silica is used, it can be selected from the following group of commercially available fumed silica: Cab-O-Sil LM-150, Cab-O-Sil M-5, Cab-O-Sil MS-55, Cab-O-Sil MS-75D, Cab-O-Sil H-5, Cab-O-Sil HS-5, Cab-O-Sil EH-5, Aerosil 150, Aerosil 200, Aerosil 300, Aerosil 350, and/or Aerosil 400.

In one embodiment, the substrate can be coated with fumed silica (modified or unmodified). Specifically, in one embodiment, the aggregate size of the fumed silica can be from approximately 50 to 300 nm in size. More specifically, the fumed can be from approximately 100 to 250 nm in size. The Brunauer-Emmett-Teller (BET) surface area of the fumed silica can be from approximately 100 to 400 square meters per gram. More specifically, the fumed silica can have a BET surface area from approximately 150 to 300 square meters per gram.

Alternatively, the substrate may be coated with an alumina (modified or unmodified). In one embodiment, the alumina coating can comprise pseudo-boehmite, which is aluminum oxide/hydroxide ($Al_2O_3.n\ H_2O$ where n is from 1 to 1.5). Additionally, in another embodiment, the substrate can be coated with an alumina that comprises rare earth-modified boehmite, such as those selected from lanthanum, ytterbium, cerium, neodymium, praseodymium, and mixtures thereof. Commercially available alumina particles can also be used, as are known in the art, including, but not limited to, Sasol Disperal HP10, Disperal HP14, boehmite, Cabot Cab-O-Sperse PG003 and/or Cabot SpectrA1 81 fumed alumina.

As mentioned above, the layer of fumed silica and/or alumina can be treated with silane coupling agents containing amino functional groups, ACH, other functional or modifying materials, or the combination of the treating agents above. A binder can be added to the composition to bind the particulates together. Typically, an amount of binder is added that provides a balance between binding strength and maintaining particulate surface voids and inter-particle spaces for allowing ink to be received. Exemplary binders for use according to the present invention include polyvinyl alcohols such as water soluble copolymers of polyvinylalcohols including copolymer of polyvinylalcohol and polyethylene oxide) and copolymer of polyvinylalcohol and polyvinylamine, cationic polyvinylalcohols, acetoacetylated polyvinylalcohols, and silyl-modified polyvinylalcohol; also polyvinylacetate, polyvinylpyrrolidone, modified starches, water soluble cellulose derivatives, polyacrylamides, casein, gelatin, soybean protein, conjugated diene copolymer latexes, acrylic polymer latexes, vinyl polymer latexes, functional group-modified latexes, aqueous binders of thermosetting resins, and synthetic resin. In one embodiment, the binder can be polyvinylalcohol with % hydrolysis between 80 to 90% and 4% viscosity higher than 30 cps at 25° C. Preferred binders include Poval 235, Mowiol 56-88, Mowiol 40-88 (products of Kuraray and Clariant). In one embodiment, the binder may be present in an amount of about 5 wt % to about 30 wt % by the weight of dry fumed silica or alumina.

Additionally, the ink-receiving layer may also include any number of surfactants, crosslinkers, buffers, plasticizers, and other additives that are well known in the art.

Generally, the ink-receiving layer can have a relatively high capacity for ink printed on the print medium, where the ink load can be on the order of, for example, up to or exceeding 24 $cm^3/m^2$. However, typical ink loads of 18 $cm^3/m^2$ to 24 $cm^3/m^2$ can also be used with the methods and compositions described herein. The thickness of this layer can be thick enough to accept that ink load, or, expressed alternatively, 1 g of fumed silica can absorb about up to 1.2 g of ink. This provides a thickness or coatweight of the ink-receiving layer of about 15 to 40 $g/m^2$.

During application, the ink-receiving layer can be coated onto the substrate by any number of material dispensing machines including, but not limited to, a slot coater, a curtain coater, a cascade coater, a blade coater, a rod coater, a gravure coater, a Mylar rod coater, a wired coater, or the like.

Gloss Layer

In accordance with embodiments of the present disclosure, the ink-receiving layer can be coated with a gloss layer. Additionally, the gloss layer can comprise a plurality of layers. Generally, the gloss layer can include colloidal silica and a copolymer of vinylpyrrolidone. The particle size, as measured by diameter, of the colloidal silica can be from about 20 nm to about 150 nm. In one embodiment, the particle size can be from about 30 nm to about 100 nm. In another embodiment, the particle size can be from about 50 nm to about 100 nm. The particle size can be measured by photon correlation spectroscopy.

Colloidal silica generally refers to dispersed particles in water or in water miscible organic solvents. As such, the colloidal silica described herein can be a stable dispersion of amorphous silica particles. In one embodiment, the colloidal silica can comprise discrete silica particles suspended in water. In another embodiment, the colloidal silica can have a spherical particle shape dispersed in water. However, it is to be understood that the colloidal silica is not necessarily perfectly spherical, but can have a general spherical shape that is rounded.

Two or more colloidal silicas can be used together. Additionally, the gloss layer can include other inorganic particulates such as other metal oxides and/or semi-metal oxides, e.g., Disperal HP14 by Sasol.

The colloidal silica can be functionalized, e.g., cationic silica. Such functionalized types of colloidal silica are well known in the art. For example, Clariant Cartacoat K303C and K302C are commercially available forms of such silica. In one embodiment, the inorganic particulates in the gloss layer can be different than the inorganic particulates in the ink-receiving layer.

The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate, and methyl vinylketone, etc. In one embodiment, the copolymer of vinylpyrrolidone can be a copolymer of vinylpyrrolidone and vinylacetate. In another embodiment, the copolymer of vinylpyrrolidone can be a copolymer of vinylpyrrolidone and vinylcaprolactam. In still another embodiment, the copolymer of vinylpyrrolidone can be a copolymer of vinylpyrrolidone and polyvinylalcohol. In yet another embodiment, the copolymer of vinylpyrrolidone can be a mixture of a polymerized vinylpyrrolidone/vinylacetate copolymer and a polymerized vinylpyrrolidone/vinylcaprolactam copolymer, or can be a polymerized vinylpyrrolidone/vinylacetate/vinylcaprolactam copolymer. Additionally, the copolymer of vinylpyrrolidone can be a mixture of a polymerized vinylpyrrolidone/vinylacetate copolymer and/or a polymerized vinylpyrrolidone/vinylcaprolactam copolymer and/or a polymerized vinylpyrrolidone/vinylalcohol copolymer, such that the mixture contains at least two copolymers.

Generally, the copolymer of vinylpyrrolidone can have a weight ratio of vinylpyrrolidone to a second monomer from about 95:5 to about 30:70. In one embodiment, the copolymer of vinylpyrrolidone can have a weight ratio of vinylpyrrolidone to a second monomer from about 85:15 to about 40:60. In another embodiment, the copolymer of vinylpyrrolidone can have a weight ratio of vinylpyrrolidone to a second monomer from about 70:30 to about 50:50.

Generally, the print medium can have a binder in the ink receiving layer that is different than the copolymer of vinylpyrrolidone. As such, in one embodiment, the print medium can have an ink-receiving layer that is devoid of the copolymer of vinylpyrrolidone except for possible diffusion of the copolymer of vinylpyrrolidone at the surface of the ink-receiving layer adjacent to the gloss layer.

In one embodiment, the gloss layer can comprise colloidal silica and greater than 5 wt % of a copolymer of vinylpyrrolidone. In another embodiment, the copolymer of vinylpyrrolidone can be present in the gloss layer at from about 5 wt % to about 15 wt %. In yet another embodiment, the copolymer of vinylpyrrolidone can be present in the gloss layer greater than about 7 wt %, or from about 7 wt % to about 15 wt %. In still yet another embodiment, the copolymer of vinylpyrrolidone can be present in the gloss layer greater than about 10 wt %. As such, the copolymer of vinylpyrrolidone can be present in the gloss layer from about 5 wt % to about 15 wt %. In another embodiment, the copolymer of vinylpyrrolidone can be present in the gloss layer from about 5 wt % to about 10 wt %. In still another embodiment, the copolymer of vinylpyrrolidone can be present in the gloss layer from about 7 wt % to about 10 wt %. Embodiments having sub-ranges within these ranges are also possible.

The copolymer of vinylpyrrolidone can have a weight average molecular weight of at least 10,000 Mw. In one embodiment, the molecular weight can be at least 100,000 Mw. In another embodiment, the molecular weight can be at least 500,000 Mw. In yet another embodiment, the molecular weight can be at least 1,000,000 Mw. In still yet another embodiment, the molecular weight can be at least 2,000,000 Mw.

To improve the coating quality and curtain stability, a thickener can be used to increase the viscosity of the layer. Suitable thickeners include polyethyleneoxide, polyvinylpyrrolidone, gelatin, hydroxylethylcellulose, hydroxymethylcellulose, polyvinylalcohol, polyacrylamide, etc., including copolymers thereof, and mixtures thereof. In one embodiment, the thickener can be polyethyleneoxide. Commercially available polyethyleneoxides include Alkox E-45, E-75, E-240, E-300C, and Polyox WSR N-12K, WSR N-60K, WSR-301, WSR-303. The weight ratio of thickener and the copolymer of vinylpyrrolidone can be from 0:100 to 20:80. In one embodiment, the weight ratio can be 1:99 to 10:90. The thickener can be the same or different than the copolymer of vinylpyrrolidone.

The viscosity of the gloss layer can be varied depending on the desired application or manufacturing process. In one embodiment, the viscosity can be at least 25 cps. In another embodiment, the viscosity can be at least 30 cps. In still another embodiment, the viscosity can be at least 35 cps. The viscosity can be varied using thickeners, as previously discussed; can be varied by using an appropriate copolymer having a high molecular weight; or can be varied using copolymers that are subsequently modified. Generally, a high molecular weight can be at least 100,000. However, a combination of thickeners and various molecular weight copolymers can achieve the viscosities listed herein, including copolymers having a molecular weight less than 100,000. Additionally, copolymers can be modified. For example, a copolymer of vinylpyrrolidone and polyvinylalcohol can be cross-linked with the use of boric acid, as is well-known in the art. Such cross-linking can provide a modified copolymer that increases the viscosity of the gloss layer. One skilled in the art will recognize that numerous combinations of molecular weight, subsequent copolymer modification, and additional additives, e.g., thickeners, can provide numerous materials having the desired viscosities listed herein. As such, it is understood that such combinations are contemplated herein.

The gloss layer is generally not very porous, compared to the ink-receiving layer, and provides the desired glossiness to the product. The coatweight of the gloss layer can be about 0.1 g/m$^2$ to about 5 g/m$^2$. In one embodiment, the coatweight of the gloss layer can be from about 0.2 g/m$^2$ to about 2.0 g/m$^2$. In another embodiment, the coatweight can be from 0.1 g/m$^2$ to about 1.0 g/m$^2$.

The gloss layer can improve the gloss characteristic and the scratch resistance of the print medium significantly. In one embodiment, the print medium can have a 20° gloss of at least about 25. In another embodiment, the 20° gloss can be at least about 30. In yet another embodiment, the 20° gloss can be at least about 35.

EXAMPLES

The following examples illustrate various aspects of the ink print medium in accordance with embodiments of the present disclosure. The following examples should not be considered as limitations of the disclosure, but merely teach how to make the best print media presently known.

Example 1

Preparation of Ink-Receiving Layer

Cab-O-Sil MS-55 was treated with 3% aluminum chlorohydrate and 9% of 3-aminopropyltrimethoxysilane in water. An ink-jet receiving formulation comprising 100 parts of treated Cab-O-Sil MS-55, 21 parts of Poval 235 (Polyvinylalcohol from Kuraray), 2 parts of boric acid, 1 part of glycerol, 0.2 part of Silwet L-7600, and 0.5 part of Zonyl FSN was prepared. The % solid was 19.5% and viscosity was 200 cps at 45° C.

Example 2

Preparation of Glossy Layer

Cationic charged colloidal silica with particle size of 100 nm or less was used as the gloss layer of high image quality porous ink-jet media. Cartacoat K303C and K302C were used for this study. Cationic colloidal silica was mixed with water soluble polymers and other ingredients, including surfactants and crosslinkers. The mixture was stirred in a 50° C. bath with mechanical stirrer until all components were thoroughly mixed. Table 1 lists the polymers used as binders of the glossy layer for each formulation. Polymers, 10% by weight, were used as binders for the Cartacoat K303C. Percent solids were 30%. The glossy layer mixtures listed in Table 1 were coated on a clear PET film with a Mylor rod to give a coatweight of 5 g/m$^2$.

TABLE 1

| Polymer ID | Polymer Binder | Polymer Structure |
|---|---|---|
| 1 | ISP PVP/VA W-735 | polyvinylpyrrolidone-polyvinylacetate (70/30) |
| 2 | ISP PVP/VA S630 | polyvinylpyrrolidone-polyvinylacetate (60/40) |
| 3 | ISP PVP/VA E-535 | polyvinylpyrrolidone-polyvinylacetate (50/50) |
| 4 | Luvitec VPC 55 | polyvinylpyrrolidone-polyvinylcaprolactam (50/50) |
| 5 | Viviprint 540 | Polyvinylpyrrolidone |
| 6 | Gafquat 755N | copolymer of vinylpyrrolidone and dimethylaminoethyl methacrylate |
| 7 | PVP K-120 | polyvinylpyrrolidone |
| 8 | Luvitec VPI K65W | polyvinylpyrrolidone-vinylimidazole |
| 9 | Polyox N-12K | Polyethyleneoxide |
| 10 | Alkox E-45 | Polyethyleneoxide |
| 11 | Alkox E-300 | Polyethyleneoxide |
| 12 | Gohsefimer K-210 | cationic polyvinylalcohol |
| 13 | Mowiol 56-88 | polyvinylalcohol |
| 14 | Poval 235 | polyvinylalcohol |
| 15 | Mowiol 40-88 | polyvinylalcohol |
| 16 | WO-320R | polyvinylalcohol-polyethyleneoxide |
| 17 | Gelatin | gelatin |
| 18 | Tylose 10000P | hydroxyethyl cellulose |
| 19 | Dow HEC | hydroxyethyl cellulose |
| 20 | Viviprint 200 | Copolymer of vinylcaprolactam, DMAPM, and hydroxyethylmethacrylate |
| 21 | Viviprint 300 | Copolymer of dimethylaminopropyl Methacrylamide and hydroxyethylmethacrylate |
| 22 | PEI | Polyethyleneimine |

The polymers shown in Table 1 were further evaluated and measured for compatibility and scratch resistance as shown in Table 2 below. The transparency of the coating on PET was used as measurement of compatibility between cationic colloidal silica and polymer binder. A score of 1 to 5 was given to rank the compatibility of the coatings with 5 being the best. The mixtures were sealed with a paraffin film and cooled to room temperature overnight. A score of 1 to 5 was given to rank the stability of the mixture. If the mixture was completely phase separated and had a clear top layer, the score was 1. If the mixture was homogeneous and only had one phase, the score was 5. Additionally, scratch resistance was also measured using a score of 5 as the best scratch resistance.

As shown in Table 2, the copolymers of vinylpyrrolidone gave the best performance in stability, transparency, and scratch resistance.

TABLE 2

| Glossy Layer Formulation ID | Colloidal Silica (100 parts) | Polymer ID (10 parts Binder) | PET Transparency | Compatibility | Scratch Resistance |
|---|---|---|---|---|---|
| 1 | K303C | Polymer 1 | 5 | 5 | 5 |
| 2 | K303C | Polymer 2 | 5 | 5 | 5 |

TABLE 2-continued

| Glossy Layer Formulation ID | Colloidal Silica (100 parts) | Polymer ID (10 parts Binder) | PET Trans-parency | Compat-ibility | Scratch Resis-tance |
|---|---|---|---|---|---|
| 3 | K303C | Polymer 3 | 5 | 5 | 5 |
| 4 | K303C | Polymer 4 | 5 | 5 | 5 |
| 5 | K303C/K302C 90/10) | Polymer 1 | 5 | 5 | 5 |
| 6 | K303C/K302C (80/20) | Polymer 1 | 5 | 5 | 5 |
| 7 | K303C/K302C 70/30) | Polymer 1 | 5 | 5 | 5 |
| 8 | K303C | Polymer 1/Polymer 9 (9/1) | 5 | 5 | 5 |
| 9 | K303C | Polymer 1/Polymer 11 (9/1) | 5 | 5 | 5 |
| 10 | K303C | Polymer 5 | 1 | 1 | 3 |
| 11 | K303C | Polymer 6 | 2 | 3 | 3 |
| 12 | K303C | Polymer 7 | 1 | 1 | 3 |
| 13 | K303C | Polymer 8 | 3 | 3 | 3 |
| 14 | K303C | Polymer 9 | 5 | 5 | 2 |
| 15 | K303C | Polymer 10 | 5 | 5 | 2 |
| 16 | K303C | Polymer 11 | 5 | 5 | 2 |
| 17 | K303C | Polymer 12 | 1 | 1 | 4 |
| 18 | K303C | Polymer 13 | 2 | 2 | 4 |
| 19 | K303C | Polymer 14 | 2 | 2 | 4 |
| 20 | K303C | Polymer 15 | 2 | 2 | 4 |
| 21 | K303C | Polymer 16 | 3 | 3 | 3 |
| 22 | K303C | Polymer 17 | 1 | 1 | 4 |
| 23 | K303C | Polymer 18 | 1 | 2 | 4 |
| 24 | K303C | Polymer 19 | 1 | 2 | 4 |
| 25 | K303C | Polymer 20 | 2 | 2 | 2 |
| 26 | K303C | Polymer 21 | 2 | 2 | 2 |
| 27 | K303C | Polymer 22 | 1 | 1 | 1 |

Example 3

Preparation of High Image Quality Porous Ink-Jet Media Sheets

A polyethelene extruded paper with gelatin subbing layer is used as a substrate in this example. Only Glossy Formulation Layers 1-9 as listed in Table 2 were coated because of the superior stability and coating quality. The glossy layers were coated concurrently with the ink receiving layer by a slide coating process (wet-on-wet). The ink-jet receiving layer without the glossy layer was included as control. Some commercial high quality ink-jet paper was also included for comparison purposes. The coating composition, and the test results (20° gloss number and the scratch resistance) are shown in Table 3.

TABLE 3

| Ink-jet Media ID | Glossy Layer | 20° Gloss | Scratch Resistance |
|---|---|---|---|
| 1 | none | 15 | 2 |
| 2 | Glossy Formula 1 | 42 | 5 |
| 3 | Glossy Formula 2 | 42 | 5 |
| 4 | Glossy Formula 3 | 41 | 5 |
| 5 | Glossy Formula 4 | 39 | 5 |
| 6 | Glossy Formula 5 | 44 | 5 |
| 7 | Glossy Formula 6 | 46 | 5 |
| 8 | Glossy Formula 7 | 48 | 5 |
| HP Advanced Photo Paper | | 35 | 4 |
| Epson Premium Plus Photo Paper | | 35 | 4 |

As shown in Table 3, the formulations of the present invention provided significant improvements in gloss and scratch resistance compared to other commercial formulations. As such, the present print mediums can exhibit an improved scratch resistance as compared to a print medium not having at least 5 wt % of a copolymer of vinylpyrrolidone in a gloss layer.

It is to be understood that the above-described formulations and arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements.

What is claimed is:

1. A print medium for ink jet printing, comprising:

a) a base substrate;

b) an ink-receiving layer applied directly to the base substrate, said ink-receiving layer comprising metal oxide particulates or semi-metal oxide particulates and a binder; and c) a gloss layer applied directly to the ink-receiving layer, said gloss layer being different than the ink-receiving layer and comprising colloidal silica and greater than 5 wt % of a copolymer of vinylpyrrolidone.

2. The print medium of claim 1, wherein the colloidal silica is a stable dispersion of amorphous silica particles having a particle size from about 30 nm to about 100 nm.

3. The print medium of claim 1, wherein the copolymer of vinylpyrrolidone is a copolymer of vinylpyrrolidone and at least one monomer selected from the group consisting of polyvinylalcohol, methyl acrylate, methyl methacrylate, ethyl acrylate, hydroxyethyl acrylate, hydroxyethyl methacrylate, ethylene, vinylacetate, vinylimidazole, vinylpyridine, vinylcaprolactam, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate, and methyl vinylketone.

4. The print medium of claim 1, wherein the copolymer of vinylpyrrolidone is a copolymer of vinylpyrrolidone and vinylacetate.

5. The print medium of claim 1, wherein the copolymer of vinylpyrrolidone is a copolymer of vinylpyrrolidone and vinylcaprolactam.

6. The print medium of claim 1, wherein the copolymer of vinylpyrrolidone is a copolymer of vinylpyrrolidone and polyvinylalcohol.

7. The print medium of claim 1, wherein the copolymer of vinylpyrrolidone is:

a) a mixture of:

i) a copolymer of vinylpyrrolidone and vinylacetate copolymer, and ii) a copolymer of vinylpyrrolidone and vinylcaprolactam, or b) a copolymer of vinylpyrrolidone, vinylacetate, and vinylcaprolactam.

8. The print medium of claim 1, wherein the copolymer of vinylpyrrolidone is present in the gloss layer at from at least about 7 wt % to about 15 wt %.

9. The print medium of claim 1, wherein the gloss layer further comprises a thickener selected from the group consisting of: polyethyleneoxide, polyvinylpyrrolidone, gelatin, hydroxylethylcellulose, hydroxymethylcellulose, polyvinylalcohol, polyacrylamide, copolymers thereof, and mixtures thereof.

10. The print medium of claim 1, wherein the copolymer of vinylpyrrolidone has a weight ratio of vinylpyrrolidone to a second monomer from about 95:5 to about 30:70.

11. The print medium of claim 1, wherein the copolymer of vinylpyrrolidone has a weight ratio of vinylpyrrolidone to a second monomer from about 70:30 to about 50:50.

12. The print medium of claim 1, wherein the metal oxide particulates or semi-metal oxide particulates are fumed silica.

13. The print medium of claim 1, wherein the print medium has a 20° gloss of at least 30.

14. The print medium of claim 1, wherein the ink-receiving layer has a coatweight from about 15 $g/m^2$ to about 40 $g/m^2$.

15. The print medium of claim 1, wherein the gloss layer has a coatweight from about 0.2 $g/m^2$ to about 2 $g/m^2$.

16. The print medium of claim 1, wherein the print medium exhibits an improved scratch resistance compared to an otherwise identical print medium that does not include the copolymer of vinylpyrrolidone in its gloss layer.

17. A method of manufacturing a print medium, comprising:

a) coating a base substrate with an ink-receiving layer, said ink-receiving layer comprising metal oxide particulates or semi-metal oxide particulates and a binder; and b) coating the ink-receiving layer with a gloss layer, said gloss layer comprising colloidal silica and greater than 5 wt % of a copolymer of vinylpyrrolidone.

18. The method of claim 17, wherein the copolymer of vinylpyrrolidone is a copolymer of vinylpyrrolidone and vinylacetate.

19. The method of claim 17, wherein the copolymer of vinylpyrrolidone is a copolymer of vinylpyrrolidone and vinylcaprolactam.

20. The method of claim 17, wherein the copolymer of vinylpyrrolidone is a copolymer of vinylpyrrolidone and polyvinylalcohol.

21. The method of claim 17, wherein the copolymer of vinylpyrrolidone is:

a) a mixture of:

i) a copolymer of vinylpyrrolidone and vinylacetate copolymer, and ii) a copolymer of vinylpyrrolidone and vinylcaprolactam, or b) a copolymer of vinylpyrrolidone, vinylacetate, and vinylcaprolactam.

22. The method of claim 17, wherein the ink-receiving layer is devoid of the copolymer of vinylpyrrolidone except for possible diffusion of the copolymer of vinylpyrrolidone at a surface of the ink-receiving layer adjacent to the gloss layer.

23. The method of claim 17, wherein the copolymer of vinylpyrrolidone has a weight ratio of vinylpyrrolidone to a second monomer from about 95:5 to about 30:70.

24. The method of claim 17, wherein the print medium has a 20° gloss of at least 30.

25. The method of claim 17, wherein the gloss layer further comprises a thickener selected from the group consisting of: polyethyleneoxide, polyvinylpyrrolidone, gelatin, hydroxylethylcellulose, hydroxymethylcellulose, polyvinylalcohol, polyacrylamide, copolymers thereof, and mixtures thereof.

* * * * *

UNITED STATES PATENT AND TRADEMARK OFFICE

CERTIFICATE OF CORRECTION

PATENT NO. : 8,256,892 B2
APPLICATION NO. : 12/812893
DATED : September 4, 2012
INVENTOR(S) : Tienteh Chen et al.

It is certified that error appears in the above-identified patent and that said Letters Patent is hereby corrected as shown below:

On the Title Page, Item (75), Inventors, line 2, delete "Shuzky," and insert -- Sluzky, --, therefor.

In column 10, line 14, in Claim 1, delete "ink jet" and insert -- ink-jet --, therefor.

In column 10, line 57, in Claim 8, after "layer" delete "at".

In column 10, line 62, in Claim 9, delete "hydroxylethylcellulose," and insert -- hydroxyethylcellulose, --, therefor.

In column 12, lines 24-25, in Claim 25, delete "hydroxylethylcellulose," and insert -- hydroxyethylcellulose, --, therefor.

Signed and Sealed this
Twelfth Day of February, 2013

Teresa Stanek Rea
*Acting Director of the United States Patent and Trademark Office*